US005413034A

United States Patent [19]

Satake et al.

[11] Patent Number: 5,413,034

[45] Date of Patent: May 9, 1995

[54] RESISTANCE MEMBER ADJUSTING MECHANISM OF ABRASIVE TYPE GRAIN MILLING MACHINE

[75] Inventors: Satoru Satake, Tokyo; Yutaka Okada; Shigeru Ariji, both of Higashihiroshima, all of Japan

[73] Assignee: Satake Corporation, Tokyo, Japan

[21] Appl. No.: 259,171

[22] Filed: Jun. 10, 1994

[30] Foreign Application Priority Data

Aug. 6, 1993 [JP] Japan ..... 5-215072

[51] Int. Cl.[6] ..... B02B 3/00

[52] U.S. Cl. ..... 99/519; 99/523; 99/528; 99/603; 99/607; 99/608; 99/617

[58] Field of Search ..... 99/518, 519, 525–528, 99/602–607, 610–617, 523, 608, 622, 618, 619, 628; 241/86.1, 88.2, 93; 426/481–483

[56] References Cited

U.S. PATENT DOCUMENTS

| | | | |
|---|---|---|---|
| 862,975 | 8/1907 | Kerr et al. | 99/607 |
| 1,099,317 | 6/1914 | Shultz | 99/606 |
| 1,100,190 | 6/1914 | Lund et al. | 99/606 |
| 2,618,307 | 11/1952 | Keller | 99/606 |
| 3,960,068 | 6/1976 | Salete | 99/606 |
| 4,583,455 | 4/1986 | Salete-Garces | 99/519 |
| 4,843,957 | 7/1989 | Satake | 99/524 |
| 5,036,757 | 8/1991 | Mueller | 99/618 |
| 5,209,158 | 5/1993 | Salete | 99/521 |

FOREIGN PATENT DOCUMENTS

| | | |
|---|---|---|
| 32-3020 | 5/1932 | Japan . |
| 54-3098 | 2/1979 | Japan . |
| 61-50653 | 11/1986 | Japan . |

*Primary Examiner*—Timothy F. Simone
*Attorney, Agent, or Firm*—Darby & Darby

[57] ABSTRACT

An abrasive type vertical grain milling machine comprises a perforated cylindrical body which serves to define an outer periphery of a grain milling chamber and which has a plurality of vertically arranged resistance members projected radially into the grain milling chamber so as to impart resistances to motions of the grains in a circumferential direction of an abrasive type roll assembly, an amount of projections of each of the resistance members being made to be adjustable, and further has projection amount adjusting mechanisms for adjusting independently the respective amounts of projection in the radial direction of the plural resistance members located in different vertical positions, and therefore, it is possible to adjust independently the resistance imparted to the motions of the grains within the grain milling chamber in each of the upstream-side region and downstream-side region of the grain milling chamber.

10 Claims, 5 Drawing Sheets

RESISTANCE MEMBER ADJUSTING MECHANISM OF ABRASIVE TYPE GRAIN MILLING MACHINE

FIELD OF THE INVENTION

The present invention relates to a vertical grain milling machine in which grains to be milled are introduced into a grain milling chamber from vertical one end of the grain milling chamber and the grains having been milled are discharged from the other end of the same, and more particularly, to a resistance member adjusting mechanism for an abrasive type vertical grain milling machine of the type that comprises an abrasive roll assembly mounted on a main shaft extending straight in the vertical direction and a porous or perforated cylindrical body extending vertically around the roll assembly leaving a space therefrom so as to form a cylindrical grain milling chamber around the roll assembly in cooperation with the outer peripheral surface of the roll assembly, having a large number of holes or perforations through which bran produced in the grain milling chamber is allowed to be released, and partially provided with a resistance member radially projected into the grain milling chamber so as to impart a resistance to movement of the grains in the circumferential direction of the roll assembly, a magnitude or amount of radially inward projection of the resistance member being adjustable.

The grain to be milled is not limited to rice grain but may be other grain such as wheat grain or coffee bean.

DESCRIPTION OF RELATED ART

Japanese Patent Examined Publication No. 54-3098 (B) and U.S. Pat. No. 3,960,068 corresponding thereto disclose a vertical grain milling machine which comprises knives, as resistance members, projected radially into a grain milling chamber through gaps between wall portions of a drum screen serving as a main body of a porous or perforated cylindrical body so as to impart a resistance to movement of the grains in the circumferential direction of a grain milling roll assembly, and link mechanisms of handle-operation type serving as adjusting mechanisms for adjusting a magnitude or amount of projection of the knives. More specifically this grain milling machine comprises two knives and these two knives are so arranged as to extend through the gaps between the wall portions of the drum screen to be opposite to each other in the direction of the diameter.

It is noted that the grain milling machine disclosed in this prior art is a friction type grain milling machine.

In the grain milling machine of this prior art, grains to be milled such as rice grains are introduced into a milling or whitening chamber from a lower end thereof by means of a screw feeder and, when they are sent upwards in the vertical direction while being forcibly rotated in the circumferential direction by a friction type milling or whitening roll within the whitening chamber, the rice grains are rubbed each other and outer surfaces thereof are scraped so that they are milled or whitened. Rubbing between the rice grains becomes more intense as the amount of projection of the knives serving as the resistance members is increased to impart a higher resistance to the movement of the rice grains in the circumferential direction, with a result that the milling or whitening action is performed more powerfully.

However, since the size of the rice grain becomes smaller with the progress of the milling or whitening of the rice grain, in the steady state of the machine where the rice grains are supplied at a constant flow rate for example, the resistance imparted to the movement or flow of the rice grains becomes smaller in the downstream-side (upper) region of the whitening chamber as compared with the upstream-side (lower) region of the same. Accordingly, there is a possibility that, in the downstream-side region, since the intensity of rubbing between the rice grains which depends on the amount of projection of the knives serving as resistance members becomes lower as compared with the upstream-side region, it becomes hardly possible to achieve a sufficient whitening action. Particularly in the case of an abrasive type grain milling machine, this tendency is remarkable. Further, in case of using such resistance adjusting mechanism in the abrasive type grain milling machine, it may become difficult to adjust the mechanism during the whitening action.

Japanese Patent Examined Publication No. 61-50653 (B) discloses such a technology that knives are provided on an outer periphery of a roll facing to the knives serving as the resistance members constituting a part of the porous cylindrical body, and a shim of a desired thickness is disposed between the roll and each outer peripheral knife so as to adjust the distance between the knives on the outer periphery of the roll and the knives of the cylindrical body.

Considering from the above viewpoint, there is the same possibility in the technology disclosed in Japanese Patent Examined Publication No. 61-50653 (B) as that in the technology of Japanese Patent Examined Publication No. 54-3098 (B) or U.S. Pat. No. 3,960,068.

Moreover, Japanese Patent Examined Publication No. 32-3020 discloses an abrasive type grain milling machine in which a roll assembly is formed by a plurality of abrasive type roll elements mounted on a horizontal main shaft while being spaced from each other in the direction in which the main shaft extends, and a distance between the adjacent roll elements and a horizontal thickness of the roll element in the upstream-side region with respect to the direction of the movement of the grains are different from those in the downstream-side region, so as to make it possible to cope with the differences in the grain milling conditions and the bran removing conditions between the upstream-side region and the downstream-side region.

However, in Japanese Patent Examined Publication No. 32-3020, there is no description about the technology concerning the resistance member.

SUMMARY OF THE INVENTION

The present invention was developed in view of the various points described above and an object of the invention is to provide an abrasive type vertical grain milling machine, more particularly a resistance adjusting mechanism therefor, which is capable of adjusting independently the resistance imparted to motions of grains within a grain milling chamber in each of an upstream-side region and a downstream-side region of the grain milling chamber.

According to the present invention, the above object can be achieved by an abrasive type vertical grain milling machine in which a cylindrical body comprises a plurality of vertically arranged resistance members projected radially into a grain milling chamber so as to impart resistances to motions of grains in a circumferential direction of the roll assembly, an amount of projection of each of the resistance members being made to be adjustable, and projection amount adjusting means for adjusting independently the respective amounts of projection in the radial direction of the plural resistance members located in different vertical positions.

In the abrasive type vertical grain milling machine according to the present invention, since the respective amounts of projection in the radial direction of the plural resistance members located in different vertical positions, that is, located in an upstream-side region and a downstream-side region of the grain milling chamber can be adjusted independently by the projection amount adjusting means, the distance between the resistance member and the outer peripheral surface of the abrasive roll assembly can be adjusted individually in each of the upstream-side region and the downstream-side region of the grain milling chamber, with a result that the resistance imparted to the flowing grains in the grain milling chamber can be adjusted independently in each of the upstream-side region and the downstream-side region of the grain milling chamber.

According to the present invention, it is preferred that the cylindrical body comprises a plurality of stanchions circumferentially spaced apart from each other and extending substantially in the vertical direction, and porous or perforated arcuate plate members disposed between the circumferentially adjacent stanchions and each forming a part of a cylinder of the cylindrical body, and the plural resistance members are attached to at least one of the plural stanchions so as to be located in different vertical positions on a side of this at least one of the stanchions facing to the grain milling chamber through the projection amount adjusting means while being movable in the radial direction of the roll assembly with respect to this at least one of the stanchions.

In this case, disposition and positional control of the plural resistance members can be performed easily with a relatively simple construction.

According to the present invention, it is preferred that the cylindrical body comprises a plurality of stanchions circumferentially spaced apart from each other and extending substantially in the vertical direction, and porous or perforated arcuate plate members disposed between the circumferentially adjacent stanchions and each forming a part of a cylinder of the cylindrical body, and the plural resistance members are attached to each of the plural stanchions so as to be located in different vertical positions on a side of the associated stanchion facing to the grain milling chamber through the projection amount adjusting means while being movable in the radial direction of the roll assembly with respect to the associated stanchion.

In this case, rotation or revolution of the grains in the circumferential direction as well as rolling of the same are suppressed or damped at each of the plural resistance members so as to promote the milling or whitening, and the degree of such suppression or damping is varied in accordance with the degree of resistance or protrusion, and therefore, it is also possible to change the milling action for the grains and accordingly a portion of the grain is to be milled or scraped mainly.

According to the present invention, it is preferred that each of the plural resistance members supported by said each stanchion extends in the vertical direction and a distance between adjacent end portions of the vertically adjacent resistance members is smaller than a size of the grains to be milled.

In this case, there is no possibility that the small gap between the adjacent end portions of the resistance members is clogged with the grains and the like.

According to the present invention, it is preferred that each of the stanchions has a substantially U-letter form cross-section and a concave portion of the "U" faces toward the roll assembly so that the plural resistance members supported by said each stanchion are located within the concave portion at radially outward parts thereof with respect to the roll assembly.

In this case, the positions of the plural resistance members can be easily adjusted independently with a relatively simple construction.

According to the present invention, it is preferred that the projection amount adjusting means is adapted to be able to make each of the resistance members project radially inwardly until the resistance member is brought into contact with the outer peripheral surface of the roll assembly.

In this case, even the milling of for example the grains the average size of which is different can be performed by adjusting the radial position(s) of the resistance member(s).

According to the present invention, it is preferred that the roll assembly comprises a plurality of roll elements fitted on the main shaft while being spaced from each other in the vertical direction in which the main shaft extends, and adjacent end portions of the vertically adjacent resistance members defines a small gap therebetween at a level of the space between the roll elements.

In this case, there is little possibility that the grains are pressed into the small gap owing to the pressing force applied to the grains by the roll elements during the abrasive operation.

Further, it is also possible that the roll assembly comprises a plurality of roll elements fitted on the main shaft while being spaced from each other in the vertical direction in which the main shaft extends, and adjacent end portions of the vertically adjacent resistance members defines a small gap therebetween at a level where it faces to the outer peripheral surface of one of the roll elements.

In this case, it is necessary or desired to make the gap between the both upper and lower resistance members as small as possible.

Moreover, the amount of projection of each resistance member at the upstream and downstream ends thereof may be different. For example, a single resistance member may be so disposed as to project increasingly radially further into the grain milling chamber as the resistance member extends toward the downstream side.

In this case, the distance between the surface of the roll assembly and the resistance member is suitably changed in accordance with the details of the desired grain milling action.

Further, so far as the resistance member substantially extends in the vertical direction, it may not extend vertically in parallel with the main shaft. Namely, the resistance member may extend rather or somewhat spirally such as to have vertical and circumferential components.

It is preferred that the direction of such spiral is opposite to the direction in which the grains to be milled are moved as a whole within the grain milling chamber.

In this case, the power of resistance imparted by the resistance member to the grains can be increased to the utmost limit.

The foregoing and other objects, features as well as advantages of the invention will be made clearer hereafter from detailed description of preferred embodiments with reference to drawings.

DESCRIPTION OF PREFERRED EMBODIMENTS

Next, taking a case of milling or whitening rice grain as an example of cereal grain, an abrasive type vertical rice whitening machine, which is a preferred embodiment of an abrasive type vertical grain milling machine according to the present invention, will be described with reference to FIGS. 1 to 4.

Figure 1:
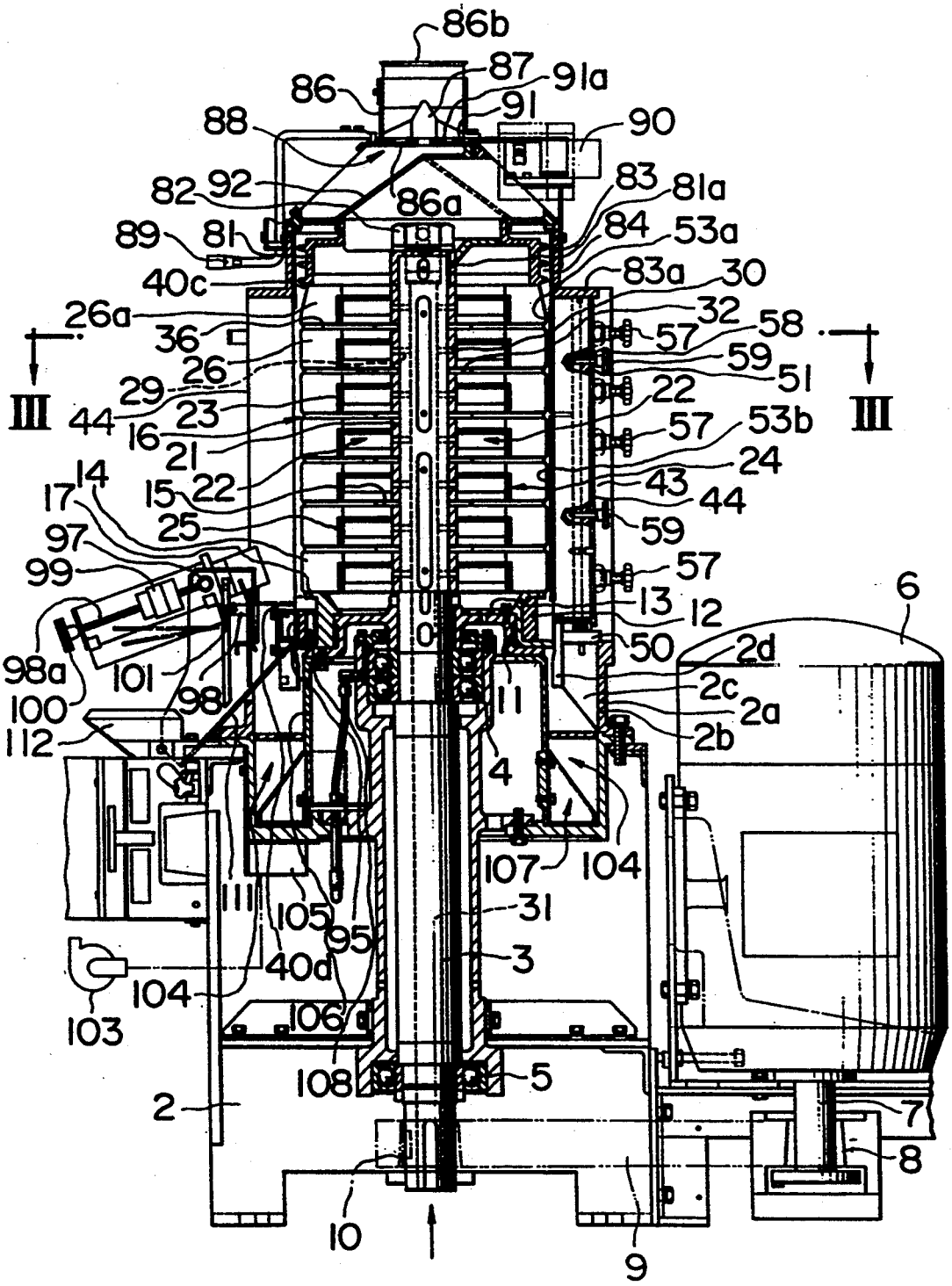
FIG. 1 is a vertical sectional view of an abrasive type vertical grain milling machine according to a preferred embodiment of the present invention (or a sectional view of FIG. 3 taken along the line I—I)

In FIG. 1 which is a general vertical sectional view of an abrasive type vertical rice whitening machine 1, reference numeral 2 denotes a base. In the central portion of the base 2, a main shaft 3 constituted by a hollow shaft extending in the vertical direction is rotatably supported by means of upper and lower bearings 4 and 5. A motor 6 is equipped sidewards of the base 2 so that rotation of an output shaft 7 of the motor 6 is transmitted through a pulley 8, a wedge belt or V belt 9 and a pulley 10 to the main shaft 3, thereby making the main shaft 3 rotate at a suitable rotational speed (generally at a rotational speed where a peripheral speed of an abrasive type roll assembly 16 to be described later becomes about 600 m/min at an outer peripheral surface thereof).

A lower rotary bottom member 11 having a cap-like cross-section is fixed to the main shaft 3 such as to be positioned above the upper bearing 4, and an upper rotary bottom member 13 formed with stirring blades 12 serving to discharge the whitened or milled white rice is fixed to the lower rotary bottom member 11.

The upper rotary bottom member 13 has a radially outward flange portion 17 on which is supported a bottom portion of the abrasive type roll assembly 16 constituted by a stack of a large number of abrasive type roll elements 14 with roll element spacers 15 interposed therebetween.

Each roll element 14 comprises a rigid abrasive cylinder support member 24 including a boss portion 21 fitted on the main shaft 3, a plurality of arm portions 22 formed integrally with the boss portion 21 and extending radially outwardly from the boss portion 21 and a cylindrical portion 23 formed integrally with the extended ends of the arm portions 22, and an abrasive cylinder 26 securely fixed to the support member 24 and formed by an aggragate of emery particles (Carborundom (trademark)).

Incidentally, among the abrasive cylinders 26, the uppermost abrasive cylinder, that is, an abrasive cylinder **26*a*** located on the most upstream side of the flowing direction of rice grains to be whitened, is formed in the shape of a circular truncated cone in order to guide the rice grains or the flow of rice grains.

Further, the hollow main shaft 3 is formed with a large number of air holes 29 in the portion thereof where the abrasive type roll assembly is fitted on, and the boss portion 21 of the abrasive cylinder support member 24 of each of the roll elements 14 is also formed therein with air holes 30. Accordingly, in case that the abrasive cylinder support member 24 of the roll element 14 is fitted on the hollow main shaft 3, at least a part of the air holes 30 formed in each boss portion 21 are communicated with at least a part of the air holes 29 formed in the main shaft 3, thereby enabling air to flow from an interior space 31 of the hollow main shaft 3 to the inside of the abrasive cylinder 26 through the air holes 29 and 30.

Figure 3:
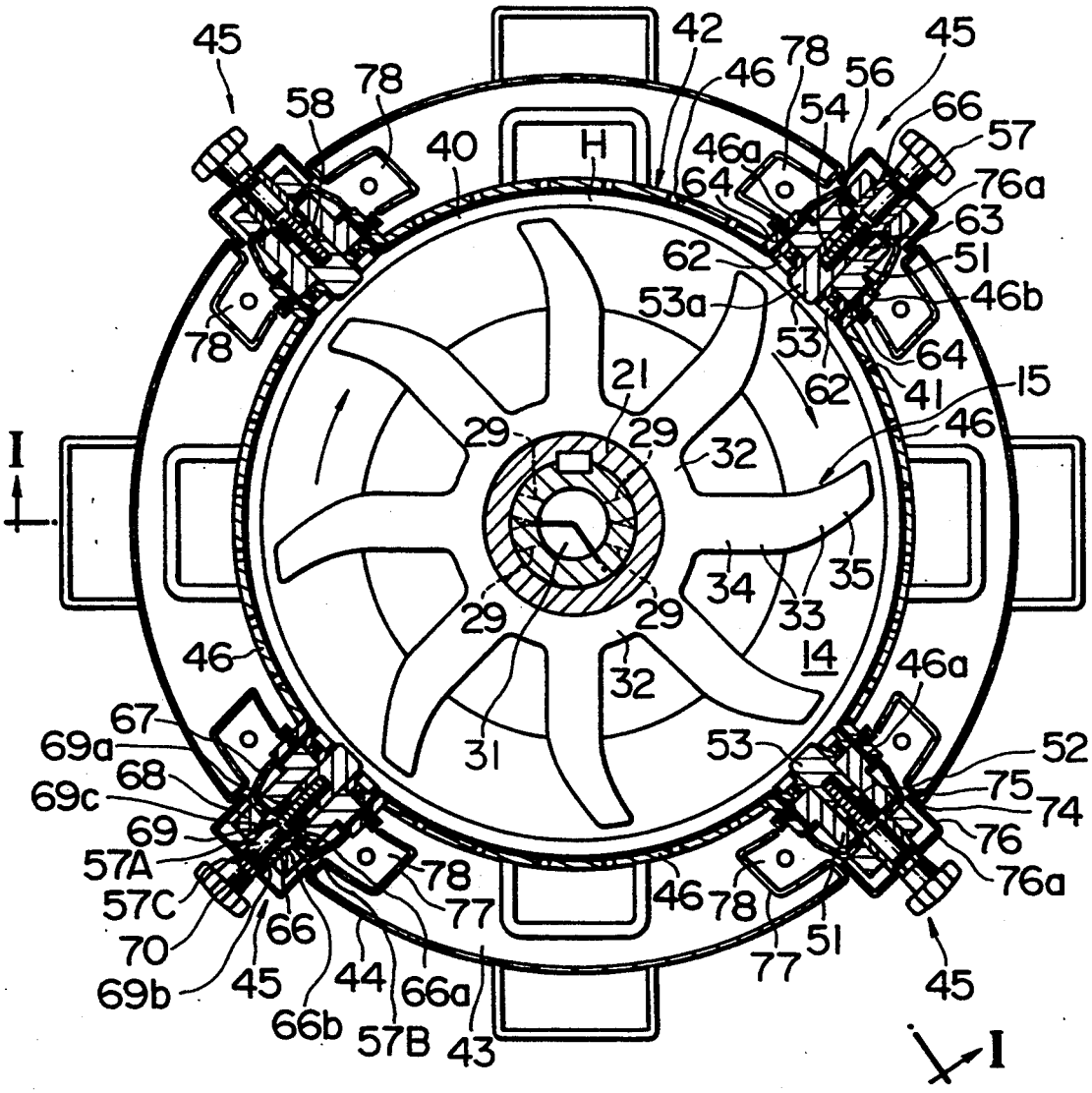
FIG. 3 is a cross-sectional view of the grain milling machine of FIG. 1 taken along the line III—III.

On the other hand, each of the roll element spacers 15 comprises, as shown in FIG. 3, a boss portion 32 having a larger outer diameter than the boss portion 21 and a plurality of ann portions 33 formed integrally with the boss portion 32 and extending substantially radially outwardly from the boss portion 32. Each arm portion 33 comprises a base-side arm portion 34 extending straight in the radial direction and a tapered tip end-side arm portion 35 extending radially outwardly from the end of the base-side arm portion 34 as turning aside in the direction opposite to the direction of rotation of the spacer 15.

Accordingly, the air having flown out from the interior space 31 of the hollow main shaft 3 to the inside of the abrasive cylinder 26 through the air holes 29 and 30 can flow out through spaces 36 defined between the adjacent arm portions 33 and 33 of every roll element spacer 15 and through between the adjacent roll elements 14 and 14. In other words, the spaces 36 serve as the bran removing jet-air outlets of the abrasive type roll assembly 16.

Around the abrasive type roll assembly 16 is disposed a porous or perforated cylindrical body 42 which cooperates with the outer peripheral surface of the roll assembly 16 to form a cylindrical grain milling chamber or a rice whitening chamber 40 around the roll assembly 16. The porous cylindrical body 42 extends vertically leaving a space from the roll assembly 16 and has a large number of holes 41 through which bran produced in the rice whitening chamber 40 is allowed to be released. Around the porous cylindrical body 42 is disposed a cylindrical cover 44 which cooperates with the porous cylindrical body 42 to define a bran removing chamber 43 serving to collect and discharge the bran.

The porous cylindrical body 42 and the cylindrical cover 44 are set on and fixed to a double-cylindrical support member **2*a* fixed to the base 2. The double-cylindrical support member 2*a*** comprises an outer cylindrical support portion 2*b* fixed to the base 2 at a bottom flange thereof, ribs 2*c* projecting inwardly from the outer cylindrical support portion 2*b* at four circumferential points and an inner cylindrical support portion 2*d* formed integral with the outer cylindrical support portion 2*b* through the ribs 2*c*.

As shown in FIG. 3, the porous cylindrical body 42 comprises four resistance imparting-adjusting mechanisms 45 disposed in such circumferential positions that the cylinder defined by the cylindrical body 42 is divided into four equal parts, and metallic porous or perforated arcuate plate members 46 serving to define the cylindrical surface portions between the adjacent resistance imparting-adjusting mechanisms 45 and 45. Accordingly, the bran removing chamber 43 is divided into four sections or four chambers by the four resistance imparting-adjusting mechanisms 45. The number of the resistance imparting-adjusting mechanisms 45 may be either not greater than 3 or not smaller than 5. The plural resistance imparting-adjusting mechanisms 45 are arranged equidistantly in the circumferential direction of the cylindrical body 42 as shown in FIG. 3, for example. Further, as seen from FIGS. 1 and 2, the flow resistance imparting-adjusting mechanisms 45 and the porous arcuate plate members 46 are respectively formed to extend over the entire vertical length of the rice whitening chamber 40. A distance H between the inner peripheral surface of the porous plate member 46 and the outer peripheral surface of the abrasive roll element 14 is in the range of about 10~15 mm, for example. The distance H is decided in accordance with the kind of grain to be milled, size of emery particles of the abrasive roll element 14, rotational speed of the abrasive roll element 14 and the like.

Each flow resistance imparting-adjusting mechanism 45 comprises a stanchion or support post 51 of a substantially U-letter form cross-section extending in the vertical direction and set on and fixed to upper ends of the ribs 21*c* through a bottom plate 50, prismatic resistance claws 53*a* and 53*b* made of for example rubber and fitted disengageably in a concave portion 52, which extends in the vertical direction of "U" of each stanchion 51 and opens radially inwardly, so as to serve as upper and lower resistance members (in case of generally calling the upper and lower resistance claws, they are designated by the reference numeral 53), knob bolts 57 as adjusting member screwed in upper and lower tapped holes 54 and 55 of the respective resistance claws 53 at external thread portions 56 thereof so as to adjust the radial positions of the resistance claws 53 with respect to the stanchion 51 (in other words, distances J1 and J2 between the upper and lower resistance claws 53*a*, 53*b* and the abrasive roll element 14 (in case of generally calling, these distances are designated by the reference character J)), and set bolts 59 screwed in tapped holes of the stanchion 51 for serving, after the adjustment of the positions of the resistance claws 53, to fix the resistance claws 53 with respect to the stanchion 51 by making the tip ends thereof come in contact with an outside end faces 58 of the resistance claws 53 (hereinafter, suffixes a and b will be added, as occasion demands, even in case of describing about the member or portion which is provided equally to the upper and lower resistance members such as the knob bolt 57 and the set bolt 59, that is, the suffix a will be added for the members or portions associated with the upper resistance claw while the suffix b for the members or portions associated with the lower resistance claw). The resistance claws 53 may be made of a plastic or metallic material having suitable strength and hardness, in place of rubber.

In more detail, prismatic reinforcing pieces 62, 62 having enhanced wear proof property by quenching are screwed to the stanchion 51 at the inner peripheral ends of the stanchion 51 and on both sides of the concave portion 52, thereby forming a stanchion assembly 63 as a whole. Incidentally, each reinforcing piece 62 projects a little radially inward beyond the porous arcuate plate member 46 bent in the form of a circular arc by about 2 mm, for example. On the other hand, circumferential end edge portions 46*a* and 46*b* of each porous arcuate plate member 46 are pressed on and fixed to side walls of the associated stanchion assemblies 63 by means of stiffening plates 64.

Reference numeral 66 denotes hollow stud bolts. A small diameter external thread portion 66*a* of the bolt 66 is screwed in the tapped hole of the stanchion 51, while a nut 68 serving to fix a cover 67 is screwed to a large diameter external thread portion 66*b* of the bolt 66. On the other hand, the external thread portion 56 of the knob bolt 57 is loosely fitted in a small diameter portion 69*a* of a hole 69 of the hollow bolt 66, while a large diameter portion 57A of the knob bolt 57 is rotatably inserted in a large diameter portion 69*b* of the hole 69. Incidentally, in a state that an end face 57B of the large diameter portion 57A of the knob bolt 57 is in contact with a stepped portion 69*c* of the wall of the hole 69, a stopper ring 70 is fitted in an annular groove 57C of the knob bolt 57 and the end portion of the stud bolt 66 is caulked, thereby prohibiting the knob bolt 57 from displacing in the axial direction thereof with respect to the bolt 66 and, hence, to the stanchion 51.

In case of adjusting the distance J between the resistance claw 53 and the roll element 14, the set bolt 59 is first unfastened or loosened and, then, the knob bolts 57 screwed respectively in the tapped holes 54 of the stanchion 51 are turned so as to make the upper and lower portions of the resistance claw 53 come close to and away from the roll element 14 by a specified length. Subsequently, the set bolt 59 is fastened again finally.

Usually, in order to make the resistance claw 53 extend substantially exactly in the vertical direction, angles through which the knob bolts 57 are turned with respect to the tapped holes 54 for adjustment are made equal to each other. However, if desired, the angles through which the knob bolts 57, 57 are turned with respect to the tapped holes 54, 55 for adjustment may be differed from each other so as to slightly incline the resistance claw 53 in such a manner that the distance J between the resistance claw 53 and the abrasive roll assembly 16 becomes smaller or larger as going downwards, for example. In this case, a vertical discrepancy (or the angle of inclination) is small as compared with the length of the resistance claw 53.

The above operation of adjusting the position of the resistance claw is performed independently for each of the upper and lower resistance claws 53*a* and 53*b* by handling or operating the associated knob bolts 57*a*, 57*b* and the set bolts 59*a*, 59*b*, respectively. For instance, in case that there is a possibility that an intensity of pressing the rice grains is lowered as going downwards in the rice whitening chamber 40 with the progress of the whitening of the surface of rice grains because the bran can be easily removed from the rice whitening chamber 40 sufficiently, the distance J1 between the upper resistance claw 53*a* and the abrasive roll assembly 16 is made larger than the distance J2 between the lower resistance claw 53b and the abrasive roll assembly 16 (see FIG. 4). On the other hand, in case that it is difficult to remove the bran sufficiently and hence the bran is apt to be collected in a lower part of the rice whitening chamber 40, the distance J1 between the upper resistance claw 53a and the abrasive roll assembly 16 is made smaller than the distance J2 between the lower resistance claw 53b and the abrasive roll assembly 16. Incidentally, in selecting and setting the distances J1, J2 between the upper and lower resistance claws 53a, 53b and the abrasive roll assembly 16, other various reasons or conditions as desired are taken into consideration.

Figure 5:
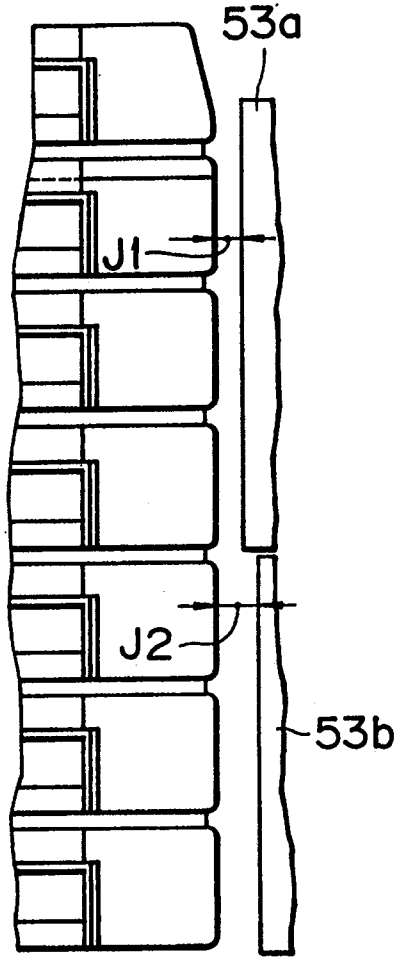
FIG. 5 is an explanatory view of a modification of the arrangement of the resistance claws shown in FIG. 4.

Further, in the case shown in FIGS. 1 to 4, the upper resistance claw 53 is shorter in vertical length than the lower resistance claw 53b, and however, the length of the upper resistance claw 53a may be made longer than the length of the lower resistance claw 53b as shown in FIG. 5. Moreover, as shown by imaginary line 80 in FIG. 4, the resistance member 53 may be formed therein with grooves at positions thereof facing to the jet-air outlets 36 in order to prevent the jet-air outlets 36 and the vicinity thereof from being clogged with the rice grains.

Figure 2:
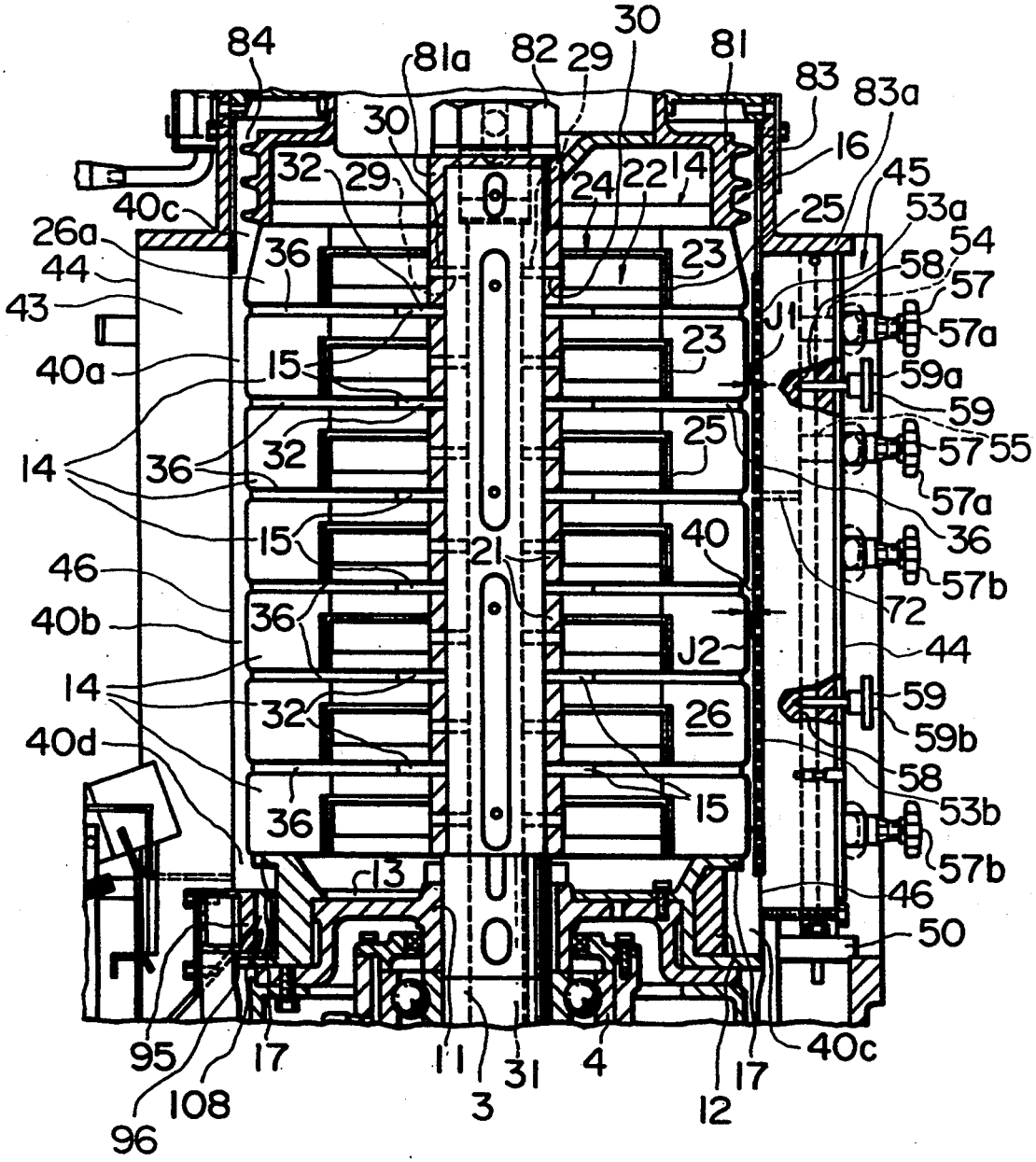
FIG. 2 is an enlarged sectional view of a part of the grain milling machine of FIG. 1.
Figure 4:
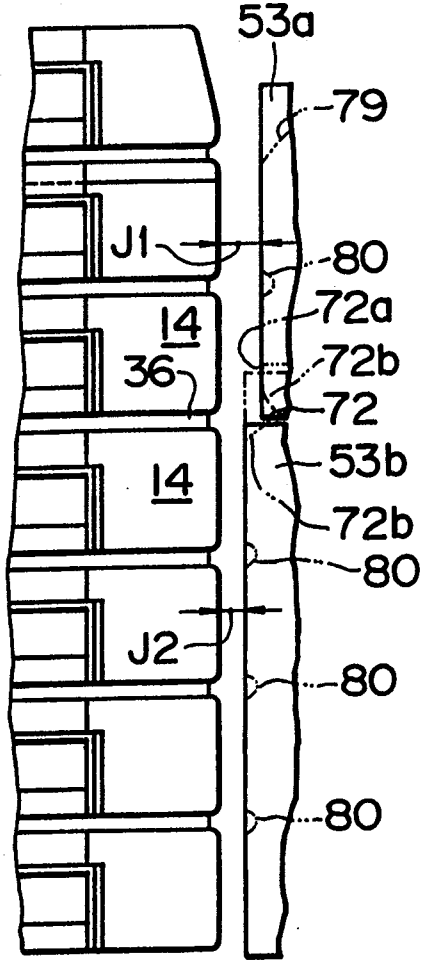
FIG. 4 is an explanatory view showing, in exaggeration, relation (distance relation) between resistance claws and an abrasive roll assembly of the grain milling machine of FIG. 1.

In addition, in the case illustrated in FIGS. 1 and 2, a small gap 72 between the lower end of the upper resistance claw 53a and the upper end of the lower resistance claw 53b is situated just at a level facing to the jet-air outlet 36 between the roll elements 14, 14, and however, as shown by imaginary line 72a in FIG. 4, the lengths of the upper and lower resistance claws 53a and 53b may be so selected as to form the gap 72a at a level where it faces to the outer peripheral surface of one of the plural roll elements 14. Incidentally, although the resistance claw 53 is shown as being extended over the entire length of the rice whitening chamber 40, it may be so provided as to extend over a part of the entire length of the same, that is, it may be so provided as to be present in a region not higher than a level of imaginary line 79 as shown in FIG. 4, for example.

Further, the size of the gap 72 is selected to be in a range which can eliminate a possibility that the rice grains are caught or taken in the gap to hinder the flow of the rice grains to be whitened. Moreover, as shown by imaginary line 72b in FIG. 4, at least one of the lower end of the upper resistance claw 53a and the upper end of the lower resistance claw 53b may be tapered or rounded.

Figure 6:
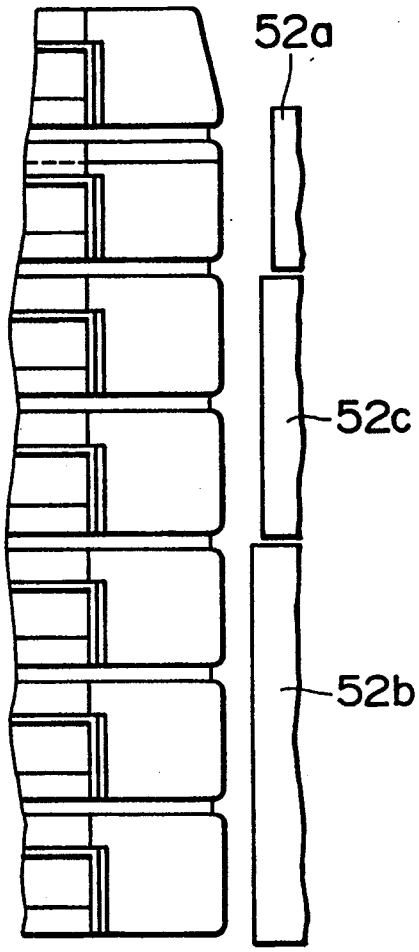
FIG. 6 is an explanatory view of another modification of the arrangement of the resistance claws shown in FIG. 4.

In addition, the number of the resistance claws 53 which are supported substantially in series by a single stanchion assembly 63 and have their positions adjusted by the knob bolts 57 and the set bolt 59 individually or independently may be three as shown in FIG. 6 or more, in place of two.

Figure 7:
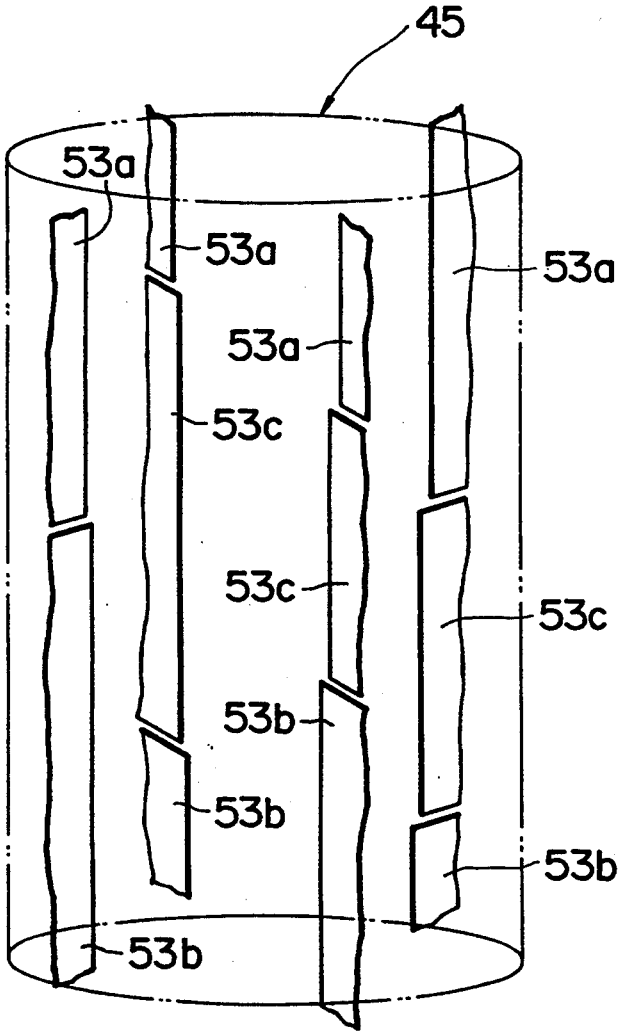
FIG. 7 is an explanatory view of skill another modification of the arrangement of the resistance claws shown in FIG. 4.

Further, in the above description, the two resistance claws 53a and 53b provided in every four circumferential points are assumed to have the same length and the same configuration, respectively, and however, the resistance claws 53 provided in at least one of four circumferential points, e.g., in all of the four points, may be made of different combination of the resistance claws 53a, 53b and the like, as shown in FIG. 7.

In the case shown in FIGS. 6 and 7, the resistance imparted to the flow of rice grains can be adjusted or changed delicately as the more than two resistance claws are held in vertical positions.

Referring back to FIG. 3, as shown therein in detail, the cylindrical cover 44 serving as an outer peripheral wall of the bran removing chamber 43 has fitting portions 74 in portions thereof corresponding to the knob bolts 57, and an outer cover 76 of the knob bolt 57 is fitted in a bent portion 75 of each of the fitting portions 74. An outer surface 76a of the cover 76 is marked with a scale which shows the adjusted distance J of the resistance claw 53 proportional to the turning angle of the knob bolt 57 for adjustment. Incidentally, each of the bent portions 75 of the cover 44 is further extended so as to cover around the movable portion of the knob bolt 57 within the bran removing chamber 43. Each of the extended portions 77 is further fitted detachably on a fixed seat 78 of the stanchion 51.

Referring back to FIGS. 1 and 2, reference numeral 81 denotes a hollow bottomless feed roll having a feed screw on the outer peripheral surface thereof. The feed roll 81 is set on the uppermost roll element 14 while being fitted at a boss portion 81a thereof on the main shaft 3 and securely fixed to the main shaft 3 together with the abrasive roll assembly 16 by means of a bolt 82 screwed in a tapped hole in the upper end of the main shaft 3. Further, reference numeral 83 denotes a feed cylinder which forms a supply chamber 84 of the rice grains to be whitened in cooperation with the feed roll 81, and a flange portion 83a at the lower end of the feed cylinder 83 is set on and fixed to the upper end of the stanchion 51 and the cylindrical cover 44 as a part of the frame of the rice whitening machine 1.

In addition, reference numeral 86 denotes a hopper into which the rice grains to be whitened are thrown, 87 denotes an upper rice grain guide member, and 88 denotes a feed amount regulating gate. The gate 88 is operated manually through a handle 89 or automatically by a motor 90 so as to adjust a position of a movable plate 91 with an opening 91a with respect to a bottom opening 86a of the hopper 86, so that the amount of rice grains to be fed from the hopper 86 into the supply chamber 84 is regulated. Reference numeral 92 denotes a lower guide member serving to feed the rice grains introduced through the gate 88 into the supply chamber 84 while dispersing the same.

Reference numeral 95 denotes a resistance board provided at a discharge port 96 through which the rice grains having been whitened in the rice whitening chamber 40 are discharged. A pressing force applied to the rice grains in the rice whitening chamber 40 by the resistance board 95 is regulated by adjusting the position of a weight 99 screwed to one arm 98a of a lever 98 supported by a pivot shaft 97 by means of a handle (knob) 100. Numeral 101 denotes an expansion spring 101.

Reference numeral 103 denotes a bran collecting fan which serves to release through an exhaust pipe 105 the bran collected in a bran collecting chamber 104 formed at the bottom of the bran removing chamber 43. Incidentally, a bottom cylindrical member 106 defining the inner peripheral wall of the bran collecting chamber 104 is fixed to the lower rotary bottom member 11, and the bottom cylindrical member 106 is provided with discharge blades 107 serving to promote the discharge of the bran from the bran collecting chamber 104 when the bottom cylindrical member 106 is rotated together with the lower rotary bottom member 11.

Next, description will be given of handling and operation of the rice whitening machine 1 thus constructed which is a preferred embodiment of the abrasive type vertical grain milling machine according to the present invention, with reference to FIGS. 1 to 4.

First, the rice whitening conditions of the abrasive type vertical rice whitening machine 1 are set and adjusted in accordance with the characteristics or properties of the rice grains to be whitened.

More specifically, in accordance with various properties such as the shape of grain determined by the sizes of the rice grains to be whitened in both directions of long (minor) and short (minor) axes thereof before rice whitening, the average sizes of the rice grains in both directions of long and short axes thereof obtained after rice whitening, and the thickness and hardness of the surface layer of rice grain to be removed by the rice whitening machine 1, the radial positions of the resistance claws 53*a* and 53*b* are adjusted by handling the knob bolts 57 and the set bolts 59 while considering the diameter and rotational speed of the abrasive roll assembly 16, the abrasive characteristic of the abrasive roll element 14, the bran removing characteristic of the bran removing system including the exhaust fan 103 and so on.

The distance J1 between the upper resistance claw 53*a* and the abrasive roll element 14 is adjusted and set mainly in accordance with relationship between sizes of the rice grains to be whitened in both directions of long and short axes thereof before rice whitening and desired sizes of the rice grains after rice whitening, while the distance J2 between the lower resistance claw 53*b* and the abrasive roll element 14, that is, a difference (J1−J2) in radial position between the lower resistance claw 53*b* and the upper resistance claw 53*a* is adjusted and set mainly in accordance with the desired sizes (generally, shape) of the rice grains in both directions of long and short axes thereof obtained after rice whitening.

Incidentally, the distance J2 between the lower resistance claw 53*b* and the abrasive roll element 14 is generally set to be rather large with the decrease of the hardness of the surface layer to be removed by the rice whitening machine 1. The above adjustment of the distances J1 and J2 may be even performed during the rice whitening operation while stopping the rotation of the abrasive roll assembly 16 (or while permitting the roll assembly 16 to rotate under certain circumstances).

On the other hand, by adjusting the position of the weight 99 on the lever 98*a* by turning the knob 100, the pressing force resulting from the resistance board 95, that is, the pressure applied to the rice grains in the rice whitening chamber 40 by the resistance board 95 is regulated. Incidentally, this pressure regulation may be performed during the rice whitening as well.

After the initialization described above, the cover 86*b* is opened and the rice grains to be whitened are thrown into the hopper 86 as the gate 88 is being closed and, at the same time, the motor 6 is started to rotate the abrasive roll assembly 16 and the feed roll 81 through the main shaft 3, with a result that the exhaust fan 103 is started so as to begin blowing of air for bran removing.

Subsequently, the handle 89 or the motor 90 is operated to open the feed amount regulating gate 88 so that the rice grains to be whitened are started to be introduced into the supply chamber 84 from the hopper 86. In this case, the rice grains are supplied continuously into the supply chamber 84 as being dispersed uniformly in the circumferential direction by means of the upper and lower guide members 87 and 92. The rice grains received in the supply chamber 84 are fed continuously to an upper end 40*c* of the rice whitening chamber 40 by means of the feed roll 81.

In the steady state of the rice whitening operation of the rice whitening machine 1, the rice grains supplied in the rice whitening chamber 40 come downwards gradually while repeating intermittent rolling and rotating or revolving (or moving around the main shaft in circular motion) between the stationary porous or perforated cylindrical body 42 and the rotating abrasive roll assembly 16 under the relatively low pressing force, during which the surface of the rice grains is made to come in contact with the abrasive cylinder 26 of the roll element 14 of the abrasive roll assembly 16 so as to be scraped off by the abrasive cylinder 26. In more detail, since the rice grains are caught between the resistance claws 53*a* and the abrasive roll assembly 16 when they reach the resistance claws 53*a*, the rotating or revolving speed thereof is reduced under the influence of braking action and a large difference comes out between the rotating (revolving) speed thereof and the rotational speed of the abrasive roll assembly 16, with a result that the surface of the rice grains is scraped off by being rubbed intensively with the emery particles of the abrasive cylinder 26 of the roll assembly 16. Further, since the resistance claws 53*a* have the function of braking the general or collective flow of the rice grains in the rice whitening chamber 40, the rolling speed and the rotating speed of the rice grains in the rice whitening chamber 40 are changed intermittently, with a result that the rice whitening proceeds gradually. Moreover, since the relation between the rolling speed and the rotating or revolving speed of the rice grains can be changed delicately by the adjustment of tile resistance claws 53*a*, the shape of the rice grains to be discharged after whitening can be also changed by making use of this relation.

When the rice grains, which have been partially whitened in the upper part 40*a* of the rice whitening chamber 40 and hence a little reduced in size, reach a lower part 40*b* of the rice whitening chamber 40, they receive the whitening action by the resistance claws 53*b* in a different way from the resistance claws 53*a* because, as seen from the above description, the distance J2 between the resistance claws 53*b* and the abrasive roll elements 14 is set to a suitable value which is different from the distance J1 between the resistance claws 53*a* and the abrasive roll elements 14. Accordingly, it is possible to perform the desired rice whitening not only in the upper part 40*a* but also in the lower part 40*b* of the rice whitening chamber 40.

In addition, since a specified exit pressure is applied to the rice whitening chamber 40 by the resistance board 95 which is applied with the force of the weight 99, in case of whitening the rice grains in the aforementioned manner, the rice grains are abraded and whitened in the state that they are filled in the rice whitening chamber 40 at a suitable density so far as the rice grains are allowed to flow continuously.

The rice grains having been whitened are collected in a collector portion 108 below a lower end 40*d* of the rice whitening chamber 40. The rice grains in the collector portion 108 are gathered in a stacker 112 through a chute 111 by opening the bottom resistance board 95 against the pressing force of the weight 99 while being stirred by the rotary stirring blades 12 attached to the lower rotary bottom member 11.

Meanwhile, as the exhaust fan 103 is operated, air flows out or is exhausted through the exhaust pipe 105. Therefore, there is generated a stream or flow of air passing through the inside passage 31 of the main shaft 3, the air holes 29 and 30, the jet-air outlets 36, the rice whitening chamber 40, the holes 41 of the porous or perforated cylindrical body 42 and the bran removing chamber 43 in the mentioned order. Owing to this stream of air, the powdered matter such as bran having been produced in the rice whitening chamber 40 during the rice whitening is discharged to the bran removing chamber 43 through the holes or perforations 41 of the porous cylindrical body 42. Further, the stream of air within the rice whitening chamber 40 serves to suppress rise of temperature of the rice grains in the rice whitening chamber 40. In addition, the stream of air coming from the jet-air outlets 36 serves to remove the bran and the like matter also from the gap 72 between the resistance claws 53*a* and 53*b*. The bran having been introduced in the bran removing chamber 43 is collected in the bran collecting chamber 104 and discharged by the discharge blades 107. Further, the hopper 86 is also formed with an airflow passage (not shown) so that air having passed through this airflow passage into the hopper 86 also serves to assist the discharge of the bran from the rice whitening chamber 40. Moreover, the bran which comes in to the depth of the jet-air outlets 36 can be returned into the rice whitening chamber 40 due to the centrifugal force resulting from the rotation of the arms 33 as well as the air stream or flow.

Figure 8:
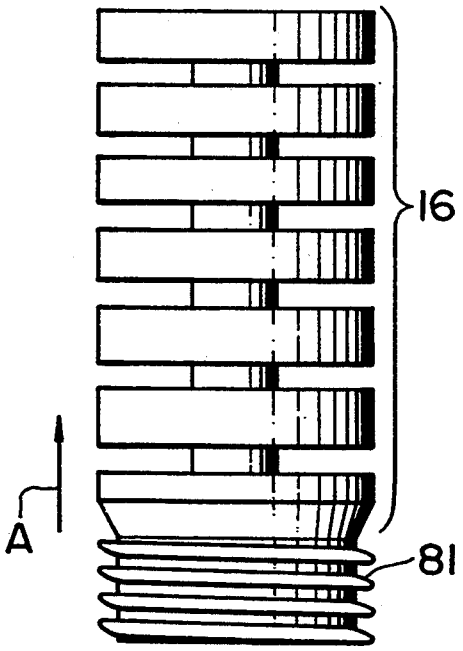
FIG. 8 is an explanatory view showing relation between an abrasive roll assembly and a feed roll in a modification of the abrasive type vertical grain milling machine of FIG. 1.

The above description has been made as to the case that the rice grains are whitened while being made to flow from top to bottom, and however, an abrasive type vertical rice whitening machine of a lift type is also available in which the feed roll 81 is disposed under the abrasive roll assembly 16 so that the rice grains are whitened while being made to flow from bottom to top in the upward direction of an arrow mark A as shown in FIG. 8.

The grain to be milled may be other grain such as wheat grain in place of rice grain. In this case, the grain milling conditions of the grain milling machine are changed in accordance with the grain size originating diffences in kind of grains as well as with the thickness, hardness and the like of the surface layer to be removed.

Incidentally, the position adjusting mechanism of the resistance claw may be for example a pistoncylinder assembly and other like means in place of the knob bolt employed in the illustrated embodiment. Further, these may be the ones which are driven electrically or by fluid pressure.

What is claimed is:

1. An abrasive type vertical grain milling machine comprising:

a main shaft;

an abrasive type grain milling roll assembly mounted on said main shaft and extending straight in a vertical direction, said roll assembly having an outer peripheral surface facing radially outward from said main shaft;

a perforated cylindrical body extending vertically around and spaced apart from said roll assembly, said cylindrical body having an inner surface facing said outer peripheral surface of said roll assembly; and a cylindrical grain milling chamber defined between said outer peripheral surface of said roll assembly and said inner surface of said cylindrical body;

wherein grains to be milled are introduced into said grain milling chamber from one vertical upstream end of said grain milling chamber and grains that have been milled are discharged from another downstream end of said grain milling chamber, and bran produced in said grain milling chamber is released through holes in said perforated cylindrical body; and wherein said cylindrical body comprises:

at least one set of a plurality of resistance members aligned vertically with each other, each said resistance member extending vertically and being projected radially into the grain milling chamber so as to impart resistances to motions of the grains in a circumferential direction of said roll assembly, an amount of projection of each of said resistance members being independently adjustable, and projection amount adjusting means for adjusting independently the respective amounts of projection in the radial direction of said plural resistance members located in different vertical positions.

2. An abrasive type vertical grain milling machine according to claim 1, wherein said cylindrical body further comprises a plurality of stanchions circumferentially spaced apart from each other and extending substantially in the vertical direction, and a plurality of perforated arcuate plate members disposed between the circumferentially adjacent stanchions and each forming a part of said cylindrical body, wherein said plural vertically aligned resistance members are attached to at least one of said plural stanchions so as to be located in different vertical positions on a side of said at least one of said stanchions facing said grain milling chamber while being movable in the radial direction of said roll assembly with respect to said at least one of said stanchions.

3. An abrasive type vertical grain milling machine according to claim 1, wherein said cylindrical body further comprises a plurality of stanchions circumferentially spaced apart from each other and extending substantially in the vertical direction, a plurality of perforated arcuate plate members disposed between the circumferentially adjacent stanchions and each forming a part of said cylindrical body, and a plurality of sets of a plurality of vertically aligned resistance members, one set being attached to each of said plural stanchions so that said resistance members in each set are located in different vertical positions on a side of the associated stanchion facing said grain milling chamber while being movable in the radial direction of said roll assembly with respect to said associated stanchion.

4. An abrasive type vertical grain milling machine according to claim 3, wherein each said resistance member extends in a vertical direction and has an end portion at each end, the distance between adjacent end portions of vertically adjacent resistance members being smaller than a size of the grains to be milled.

5. An abrasive type vertical grain milling machine according to claim 4, wherein each of said stanchions has a substantially U-letter form cross-section having a concave portion facing toward said roll assembly, said plural resistance members supported by said each stanchion being located within said concave portion at radially outward parts thereof.

6. An abrasive type vertical grain milling machine according to claim 3, wherein the vertical length of a resistance member located at said upstream end of said grain milling chamber is shorter than the vertical length of a resistance member at said downstream end of said grain milling chamber.

7. An abrasive type vertical grain milling machine according to claim 3, further comprising a plurality of bran removing chambers, each bran removing chamber being formed between circumferentially adjacent stanchions on the side of said plate members facing away from said roll assembly.

8. An abrasive type vertical grain milling machine according to claim 1, wherein said projection amount adjusting means is adapted to move each of said resistance members radially inwardly until said resistance member is brought into contact with said outer peripheral surface of said roll assembly.

9. An abrasive type vertical grain milling machine according to claim 1, wherein said roll assembly comprises a plurality of roll elements fitted on said main shaft and spaced from each other in the vertical direction in which said main shaft extends thereby defining a space between adjacent roll elements, and wherein each said resistance member has an end portion at each end, adjacent end portions of vertically adjacent resistance members defining a small gap therebetween at a level of said space defined between said roll elements.

10. An abrasive type vertical grain milling machine according to claim 1, wherein said roll assembly comprises a plurality of roll elements fitted on said main shaft and spaced from each other in the vertical direction in which said main shaft extends, each said roll element having an outer peripheral surface adjacent said outer peripheral surface of said roll assembly, and wherein each said resistance member has an end portion at each end, adjacent end portions of vertically adjacent resistance members defining a small gap therebetween at a level facing the outer peripheral surface of one of said roll elements.

* * * * *